United States Patent [19]

Hawkes et al.

[11] Patent Number: 4,892,056

[45] Date of Patent: Jan. 9, 1990

[54] DOCTOR BLADE FOR DOCTORING A FINISH LAYER OF PVC ON A STRIP OF CARPET

[75] Inventors: Gilbert E. Hawkes; Susan Fisher, both of Southampton, England

[73] Assignee: Wilton Royal Carpets Limited, Hampshire, England

[21] Appl. No.: 115,969

[22] Filed: Nov. 2, 1987

[30] Foreign Application Priority Data

Nov. 3, 1986 [GB] United Kingdom ..... 8626241

[51] Int. Cl.[4] ..... B05C 11/04

[52] U.S. Cl. ..... 118/126; 15/104 S

[58] Field of Search ..... 118/102, 123, 126, 413, 118/415; 15/104 S

[56] References Cited

U.S. PATENT DOCUMENTS 2,054,448 9/1936 Russell ..... 118/415 X 3,669,070 6/1972 Wallace ..... 118/102

FOREIGN PATENT DOCUMENTS 2439043 5/1980 France .

*Primary Examiner*—Shrive Beck

*Assistant Examiner*—Alain Bashore

*Attorney, Agent, or Firm*—Fay, Sharpe, Beall, Fagan, Minnich & McKee

[57] ABSTRACT

In the manufacture of carpet tiles an inverted strip of carpet has a scrim laid thereover and a base layer of pasty PVC is deposited on the scrim and doctored before being partially cured. Further pasty PVC is then deposited on the base layer and, as the carpet passes beneath a doctor blade, is doctored to a finish layer by the blade. The doctor blade comprises a combination of a downstream straight edged chamfered member with a narrow underface and an upstream comb like member with teeth with rounded undersides and with the width of the teeth not exceeding 25% of the tooth pitch.

5 Claims, 1 Drawing Sheet

DOCTOR BLADE FOR DOCTORING A FINISH LAYER OF PVC ON A STRIP OF CARPET

BACKGROUND OF THE INVENTION

1. Field of the Invention

The invention relates to carpet tiles and more particularly to the manufacture thereof.

2. Description of Related Art

It has previously been proposed, for example in UK Specification No. 1 336 707, to manufacture carpet tiles by doctoring a layer of thermoplastics material to a predetermined thickness on a heat-resistant carrier sheet, laying carpeting in the orientation of use, that is to say with the tufts projecting upwardly, onto the doctored layer, applying heat through the carrier sheet to cure the layer of thermoplastics material and bond it to the carpeting, stripping off the carrier sheet and cutting the carpeting into tiles.

It has also been proposed to manufacture carpet tiles with the strip to be cut up into the tiles being formed in an orientation which is inverted having regard to its orientation of use. Previous proposals involved transporting tufted carpet in an inverted orientation on a conveyor, spreading a base layer of PVC on the carpet, partially curing the base layer, rolling a reinforcing mesh into the partially cured base layer, applying a finish layer of PVC over the base layer incorporating the reinforcing mesh, doctoring the finish layer, curing the base layer and the finish layer and embossing the combined layer. The strip of carpeting was subsequently cut into tiles.

SUMMARY OF THE INVENTION

Difficulties arise in obtaining uniform thicknesses of both base and finish layers so as to provide a controlled overall thickness for the coating and also with the location of the reinforcing mesh within the thickness of the coating varying unduly. Problems particularly tend to arise with the blade doctoring the finish layer of PVC onto the base layer snagging the reinforcing mesh embedded in the base layer thus tending to lift it out of the base layer.

According to one aspect of the invention, a method of making carpet tiles comprises the steps of superimposing a reinforcing scrim and a strip of tufted carpet with the carpet in an orientation which is inverted having regard to the orientation of use and with the scrim overlying the carpet, doctoring a base layer of PVC onto the reinforcing scrim, at least partially curing the base layer, doctoring a finish layer of PVC onto the base layer, curing both the finish layer and the base layer and cutting the strip of carpet into tiles.

Thus the scrim is provided beneath the base layer rather than being provided as a sandwich filling between the base and finish layers and rolled into the base layer. The method of the invention has been found to result in a carpet which has the reinforcing scrim more uniformly located and more desirably located within the base layer, that is to say the base layer penetrates into the scrim in a direction towards the carpet rather than in a direction away from the carpet. The method of the invention also avoids difficulties involved in rolling the scrim into a pasty and sticky base layer.

The scrim is preferably a grid of non-woven strands of glassfibre with the strands initially held in place by a PVC coating. When incorporated with the PVC forming the base layer, the PVC coating and the base layer merge together.

Thus, the strip of carpet can be mounted on a stenter and, as it passes beneath the doctor blade, PVC in paste form previously deposited on the carpet is doctored by the doctor blade to a grooved layer, an accumulated bead being formed extending across the width of the carpet upstream of the doctor blade.

According to another aspect of the invention a doctor blade used to doctor a finish layer of PVC onto a strip of carpet is used in an upright orientation, is of comb-like form and comprises a straight edged member and a toothed member in juxtaposition, the straight edged member is chamfered so as to have an underface which is narrow in the direction of movement of the strip of carpet and the comb-like member has teeth each with a rounded leading lower edge and of a width not exceeding 25% of the tooth pitch.

Preferably the toothed member is provided upstream of the straight edged member. Advantageously the teeth are also rounded on their trailing lower edge and the tooth width is 20% of the tooth pitch, that is to say the gaps between the teeth are four times as wide as the width of the teeth.

Preferably the toothed member and the straight edged member are secured together by means which permit relative height adjustment. Advantageously the toothed member is of L-shape.

PVC doctored by the doctor blade can be cured by heat, preferably in an infra-red gas oven, and cooled by passing the strip of carpet under water cooled rollers. During the curing the grooved layer of PVC tends to flow out to form a layer with a fairly smooth upper surface and of uniform thickness. The layer can be subsequently embossed.

BRIEF DESCRIPTION OF THE DRAWINGS

The invention is diagrammatically illustrated by way of example in the accompanying drawing, in which.

DESCRIPTION OF THE PREFERRED EMBODIMENTS

Figure 1:
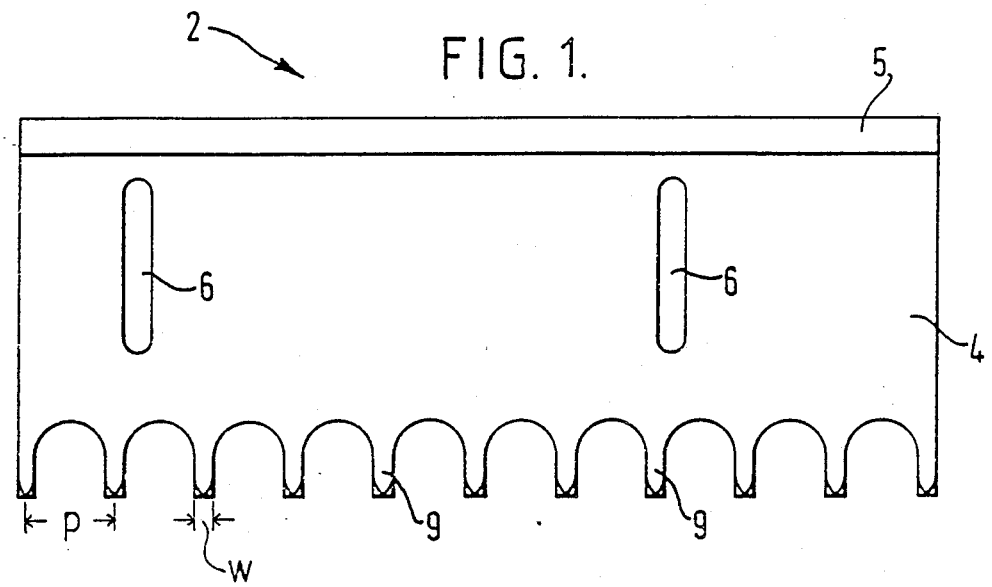
FIG. 1 is an elevation of a comb-like member of a doctor blade of apparatus to form a carpet according to said another aspect of the invention.

Referring to the drawings, a doctor blade 1 for doctoring a layer of PVC onto a carpet comprises a comb-like member 2 and a straight edged member 3. The comb-like member 2 has a vertical flange 4 and a horizontal flange 5 and the vertical flange 4 has slots 6 therein through which bolts 7 can be passed to engage in screw-threaded holes in the member 3 to clamp the members 2 and 3 together. Due to the length of the slots 6 the member 3 and the flange 4 of the member 2 are relatively adjustable in height. The lower edge of the member 3 is chamfered so that the underface 8 of the member 3 is only narrow when considered in the direction of movement A of a carpet being coated.

Figure 2:
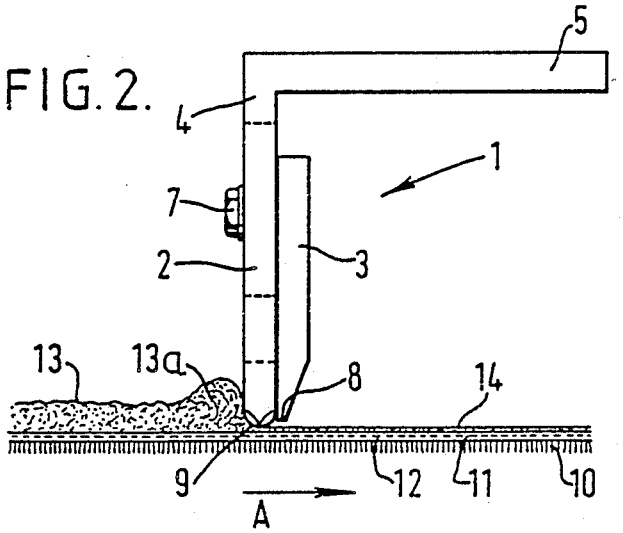
FIG. 2 is a side view showing the comb-like member of FIG. 1 combined with a straight edged member to form a doctor blade and in operation coating a strip of carpet.

The comb-like member 2 has the lower edge of its flange 4 formed with teeth 9 and the width w of the teeth in the embodiment shown is one quarter of the spacing between the teeth (tooth pitch P) such that the width of each tooth is 20% of the tooth pitch P. In one example, the teeth had a width w of 3 mm with a spacing P of 12 mm between the teeth, the teeth being of an overall height of 13 mm and the bottom edge of the teeth 9 projecting a distance of 0.8 mm below the underface 8 of the member 3. FIG. 2 particularly shows that the teeth 9 are chamfered so that the undersides thereof are rounded, that is to say the corners have been removed.

The clamped together members 2, 3 can be mounted by means of the flange 5 to overlie a stenter on which a strip of carpeting 10 is conveyed. Advantageously, the strip of carpeting is secured on the stenter by spikes projecting through the lateral edges of the strip of carpeting whereby it is under some tension. At a stage prior to that illustrated in FIG. 2, the strip of carpeting with a layer of scrim laid thereover is coated with a base layer of PVC by having PVC in pasty form deposited on the carpet and the carpet passed beneath a plain doctor blade. The doctor blade forces the pasty PVC through the scrim and into engagement with the carpet leaving the PVC as a uniform base layer on the carpet with the scrim embedded in the base layer. The base layer is then cured and the carpet is brought to the apparatus shown in FIG. 2 where further PVC 13 in pasty form is deposited upon the base layer 11 of curved PVC with the scrim 12 embedded therein. The combined member 2, 3 doctors the PVC 13 to a grooved finish layer 14 overlying the base layer 11 containing the scrim 12 without risk of the teeth 9 of the member 2 snagging the scrim 12. It can be seen that the PVC forms a uniform bead 13*a* behind, that is to say upstream of the member 2 which is provided upstream of the member 3. The composite layer of PVC formed by the layers 11 and 14 is subsequently cured, embossed and cooled and the carpeting is cut into tiles if desired or may be sold in roll form.

What is claimed is:

1. A doctor blade for doctoring a finish layer of PVC on a strip of carpet, comprising:

said doctor blade having an upright orientation, and a comb-like form including a straight edge member and a toothed member having teeth, means for securing said members together such that said straight edge member extends across said toothed member covering a portion of said teeth, said straight edge member being chamfered to provide an underface that is narrow in the direction of movement of the strip of carpet, and each of said teeth having a rounded leading lower edge and a width not exceeding 25% of a pitch of said teeth.

2. A doctor blade as claimed in claim 1, wherein said securing means further includes means for permitting relative height adjustment between said members.

3. A doctor blade as claimed in claim 1, wherein the toothed member is L-shaped.

4. A doctor blade as claimed in claim 1, wherein said toothed member is provided upstream of the straight edged member.

5. A doctor blade as claimed in claim 1, wherein each of said teeth is rounded on its trailing lower edge and has a width that is 20% of the pitch.

* * * * *